US005531252A

United States Patent [19]

Derby et al.

[11] Patent Number: 5,531,252

[45] **Date of Patent: *Jul. 2, 1996**

[54] VACUUM FILL SYSTEM

[75] Inventors: Norwin C. Derby, Dallas; Norman C. Derby, Bonham, both of Tex.

[73] Assignee: B.A.G. Corporation, Dallas, Tex.

[ * ] Notice: The term of this patent shall not extend beyond the expiration date of Pat. No. 5,234,037.

[21] Appl. No.: 485,710

[22] Filed: Jun. 7, 1995

Related U.S. Application Data

[63] Continuation-in-part of Ser. No. 302,377, Sep. 8, 1994, which is a continuation of Ser. No. 105,341, Aug. 9, 1993, abandoned, which is a continuation of Ser. No. 875,636, Apr. 28, 1992, Pat. No. 5,234,037, which is a continuation of Ser. No. 558,678, Jul. 27, 1990, abandoned, which is a continuation-in-part of Ser. No. 407,901, Sep. 15, 1989, abandoned.

[51] Int. Cl.[6] ..... B65B 1/26

[52] U.S. Cl. ..... 141/67; 141/65; 141/71

[58] Field of Search ..... 141/7, 8, 10, 59, 141/65, 67, 71, 73, 80, 114, 286, 313–317; 414/217, 221; 222/442, 445, 447, 450, 394, 637

[56] References Cited

U.S. PATENT DOCUMENTS

| | | | |
|---|---|---|---|
| 2,138,356 | 11/1938 | Ryan et al. | 141/7 |
| 2,142,990 | 1/1939 | Belcher . | |
| 2,489,925 | 11/1949 | Omwake . | |
| 2,688,416 | 9/1954 | Skretting . | |
| 2,720,375 | 10/1955 | Carter . | |
| 2,760,702 | 8/1956 | Pechy . | |
| 2,780,247 | 2/1957 | Claassen, Jr. . | |
| 2,783,786 | 3/1957 | Carter . | |
| 2,815,621 | 12/1957 | Carter . | |
| 2,964,070 | 12/1960 | Linhardt . | |
| 3,063,477 | 11/1962 | Vogt . | |
| 3,101,853 | 8/1963 | Long et al. . | |
| 3,232,494 | 2/1966 | Poarch . | |
| 3,258,041 | 6/1966 | Lau . | |
| 3,260,285 | 7/1966 | Vogt . | |
| 3,542,091 | 11/1970 | Carter . | |
| 3,586,066 | 6/1971 | Brown . | |
| 3,589,411 | 6/1971 | Vogt . | |
| 3,605,826 | 9/1971 | Carter . | |
| 3,656,518 | 4/1972 | Aronson . | |
| 3,785,410 | 1/1974 | Carter . | |
| 3,788,368 | 1/1974 | Geng et al. | 141/67 |
| 3,847,191 | 11/1974 | Aronson . | |
| 4,060,183 | 11/1977 | Puurunen . | |
| 4,182,386 | 1/1980 | Alack . | |
| 4,185,669 | 1/1980 | Jevakohoff | 141/59 |
| 4,219,054 | 8/1980 | Carter et al. . | |
| 4,397,657 | 8/1983 | Selep et al. . | |
| 4,457,125 | 7/1984 | Fishburne . | |
| 4,526,214 | 7/1985 | McGregor . | |
| 4,545,410 | 10/1985 | Paul et al. | 141/67 |
| 4,573,504 | 3/1986 | Rosenstrom . | |
| 4,614,213 | 9/1986 | Englin . | |
| 4,648,432 | 3/1987 | Mechalas . | |
| 4,854,353 | 8/1989 | Russell . | |
| 4,912,681 | 3/1990 | Halsey et al. . | |
| 5,109,893 | 5/1992 | Derby . | |

FOREIGN PATENT DOCUMENTS

| | | |
|---|---|---|
| 1265286 | 5/1961 | France . |

*Primary Examiner*—J. Casimer Jacyna
*Attorney, Agent, or Firm*—Michael A. O'Neil; Russell N. Rippamonti

[57] ABSTRACT

A vacuum fill system for deaerating flowable materials includes a hollow container connected to a plurality of valves, slide gate valves and a vacuum pump for creating a vacuum when filled with flowable materials that causes the flowable materials to deaerate and subsequently compact when atmospheric pressure is restored.

15 Claims, 5 Drawing Sheets

VACUUM FILL SYSTEM

RELATED APPLICATION

This application is a continuation-in-part under 37 C.F.R. § 1.53 of prior application Ser. No. 08/302,377 entitled VACUUM FILL SYSTEM, filed Sept. 8, 1994, currently pending, which is a file wrapper continuation of application Ser. No. 08/105,341, filed Aug. 9, 1993, now abandoned, which is a continuation of application Ser. No. 07/875,636, filed Apr. 28, 1992, now issued as U.S. Pat. No. 5,234,037, which is a continuation of application Ser. No. 07/558,678, filed Jul. 27, 1990, now abandoned, which is a continuation-in-part of application Ser. No. 07/407,901 filed Sep. 15, 1989, now abandoned.

TECHNICAL FIELD OF THE INVENTION

This invention relates to a vacuum fill system for dearating flowable materials for storage in a container, and in particular, to a vacuum fill system for deaerating and compacting flowable materials used in flexible bulk containers.

BACKGROUND OF THE INVENTION

Containers used in the storage, transportation, and dispensation of flowable materials have been around for as long as civilization itself. The use of such containers, however, has always been limited by (1) the weight, density, and other physical properties of the material being stored, and (2) by the process and type of container used to store the material.

Traditional filling processes and containers have long been encumbered by a simple phenomenon that has exasperated consumers for decades—settling. Settling, as any purchaser of a bag of potato chips knows, means the bag is never completely filled when opened. This occurs due to the settling of the product inside during its filling and shipment. This simple settling phenomenon causes tremendous economic waste each year due to the wasting of storage space and container materials. This has been particularly true in the storage, transportation, and dispensation of flowable materials in semi-bulk quantities such as grains, chemicals and other bulky substances stored in flexible, bulk containers, such as those disclosed in U.S. Pat. Nos. 4,143,796 and 4,194,652.

It has long been known that the settling process is caused by the natural aeration of flowable materials as the materials are placed inside a container. As the container is shipped to its final destination, the air is displaced from the aerated material mixture causing the product to compact and reduce in volume. Thus, when the container is opened, the flowable material has settled to the bottom of the container, i.e. the bag of potato chips is only half full.

Any process or system, such as the present invention, for storing materials in a container for shipment that allows all of the container to be filled with product and reduces the excess air results in an enormous cost savings. Indeed, the shipment of smaller sized containers using vacuum sealed packages, such as vacuum sealed coffee containers, has alleviated many of the above problems of cost and time.

Although vacuum sealed packaging has proved to be an efficient, cost-saving and consumer pleasing method of shipping small quantities of goods, before now, it has been impossible to apply such techniques into other areas of storage, transportation and dispensation of flowable materials. This has been particularly true in the market for semi-bulk flowable materials.

The present invention, however, substantially eliminates settling and the inherent problems associated therewith by providing a vacuum filling system that deaerates the flowable material during filling. The present invention thus allows more product to be transported in the same size container than is possible using prior techniques.

Additionally, by utilizing all of the container space, the present invention allows for the far more efficient total use of all of the container materials and space.

SUMMARY OF THE INVENTION

The vacuum fill system of the present invention generally comprises a hollow container for holding the flowable material; a device for controlling the flow of the flowable material into the hollow container; an apparatus for creating a vacuum in the hollow container for deaerating the flowable materials and for compacting the deaerated materials; and a device for controlling the flow of the deaerated, compacted flowable material from the first container into a storage container for shipment.

In the preferred embodiment of the invention, a first conventional full opening ball or gate valve is located at one end of the hollow container for controlling the flow of flowable materials into the first container. A conventional vacuum pump, capable of pulling a vacuum of eighteen (18) inches of mercury for deaerating the flowable materials, is connected to the hollow container through a series of valves and vacuum lines. A second conventional full opening ball or gate valve is located at the opposite end of the hollow container for controlling the flow of deaerated flowable material into the shipping container.

In this operation of the vacuum fill system, flowable material is fed into the hollow cylindrical container. A vacuum is created through the use of a plurality of valves and a conventional vacuum pump. After sufficient deaeration of the flowable material is achieved, the vacuum is released and the interior of the hollow container is returned to atmospheric pressure substantially, instantaneously causing the material to compact in a direction parallel to the axis of symmetry of the hollow container. The compacted, deaerated flowable material then drops from the first container into a flexible container for shipment.

In a second embodiment of the invention, the hollow cylindrical container incorporates tapered sidewalls. Such tapered sidewalls assist in the prevention of sticking of the compacted deaerated flowable material in the hollow cylindrical container. Furthermore compressed air is introduced into the first container to force the compacted, deaerated flowable material from the first container into the flexible container.

In the third embodiment of the invention, the hollow cylindrical container comprises an upper section with a substantially vertical sidewall and a lower section with a tapered sidewall. The two profile configurations for the sidewall in the hollow container incorporate the advantage of a straight profile in the upper portion, which provides for additional volume in the container, and a tapered profile in the lower portion, which assists in the prevention of sticking of the compacted deaerated flowable material. The hollow container of the third embodiment is preferably formed from stainless steel which is polished internally. The choice of material and polished finish further assist in the prevention of sticking of the compacted deaerated flowable material in the container.

The third embodiment provides the additional feature of a baffle plate installed in the upper section of the hollow container. This baffle plate assists in evenly distributing the shock wave created by returning the first container to atmospheric pressure.

By deaerating and compacting the flowable material before filling the flexible container, through the use of the vacuum fill system, the flowable material is presettled and will not settle during shipment. Thus, the present invention provides for more utilization of the flexible container, eliminating wasted space and allowing for the shipment of more material without any increase in the container volume.

BRIEF DESCRIPTION OF THE DRAWINGS

A more complete understanding of the invention may be had by reference to the following Detailed Description when taken in conjunction with the accompanying Drawings, in which.

DETAILED DESCRIPTION OF THE INVENTION

Figure 1:
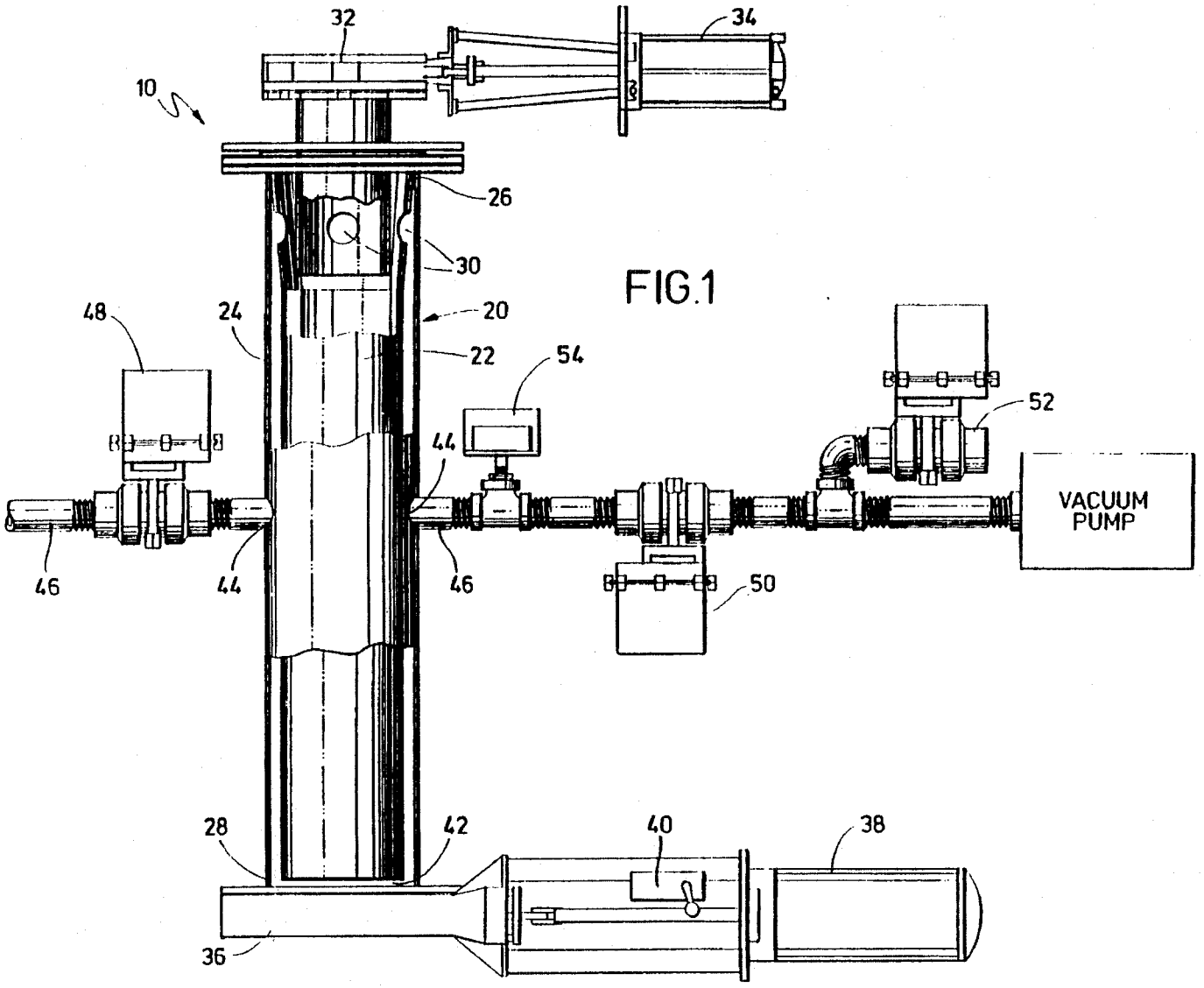
FIG. 1 is a partial sectional view of the vacuum fill system.

Referring to FIG. 1, the vacuum fill system 10 has a hollow, cylindrical container 20, having inner and outer chambers 22 and 24, respectively. Chambers 22 and 24 have first and second ends 26 and 28. The inner chamber 22 connects with the outer chamber 24 at the first end 26 of the two chambers. In the preferred embodiment, the inner chamber 22 has a plurality of openings 30 which allow for the venting of air during use.

Attached to the first end 26 of the hollow, cylindrical container 20 and its inner and outer chambers 22 and 24 is a conventional knife or slide gate valve 32 and associated air cylinder 34 which controls the opening and closing of the gate 32. The slide gate valve 32 and air cylinder 34 are of conventional types well known in the art. When the gate valve 32 is in the open position, flowable material flows through the gate valve 32 and into inner chamber 22 of the hollow, cylindrical container 20.

At the second end 28 of the hollow, cylindrical container 20, there is a second slide or knife gate valve 36, which is normally of a slightly larger diameter than slide gate valve 32. The slide gate valve 36 also has associated with it an air cylinder 38 and switch 40, both well known in the art, which are utilized to fully open or close the slide gate valve 36 to allow compacted materials to exit from the hollow, cylindrical container 20 after deaeration and compaction. Also at the second end 28 of the container 20, is a gap 42 between the bottom of the inner chamber 22 and outer chamber 24 of the container 20. The gap 42 allows air to vent and is utilized to help form a vacuum during the deaeration process.

The outer chamber 24 of the hollow, cylindrical container 20 has a plurality of openings 44 into which vacuum lines 46 run. The vacuum lines 46 do not, however, connect to the inner chamber 22. In the preferred embodiment of the invention, there are at least two openings 44 and two vacuum lines 46 running in opposite directions. One of the vacuum lines 46 is connected to a solenoid actuated butterfly valve 48 which in turn connects to a conventional dust collector (not shown). The second vacuum line 46 is connected to a series of solenoid actuated butterfly valves 50 and 52, and from there to a conventional vacuum pump (not shown).

Although any conventional vacuum pump may be utilized with the present invention, the vacuum pump must be capable of pulling a minimum of eighteen (18) inches of mercury during operation. Also connected to the second vacuum line 46 is a conventional pressure switch 54, which is utilized to control the opening and closing of the valves 50 and 52.

FIGS. 2 through 5 illustrate the operation of the vacuum fill system of the present invention. Although the vacuum fill system 10, illustrated in FIGS. 2 through 5, is used in connection with the filling of a semi-bulk container for handling flowable materials, it must be understood that the present invention is capable of being utilized with any type of container no matter how large or small where it is desired to compact, deaerate and densify the flowable materials for packing into a container for shipment and storage.

Figure 2:
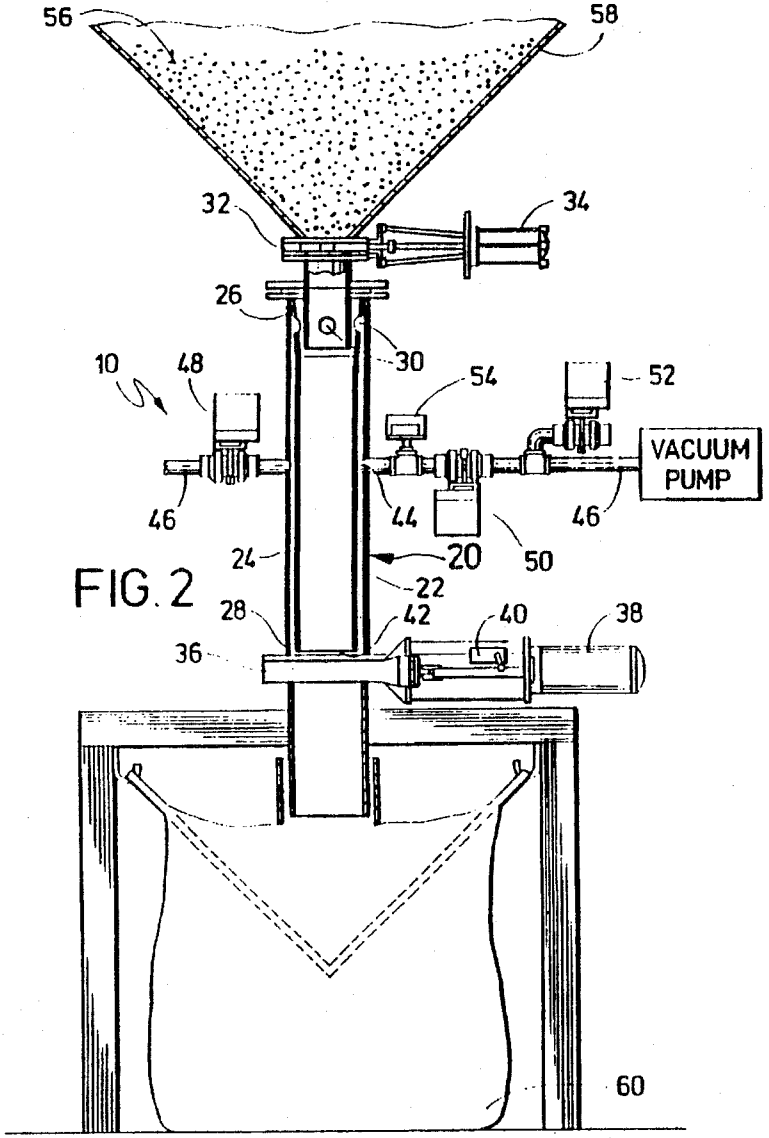
FIG. 2 is a partial sectional view of the vacuum fill system illustrating its use with semi-bulk bags used for containing flowable materials.
Figure 5:
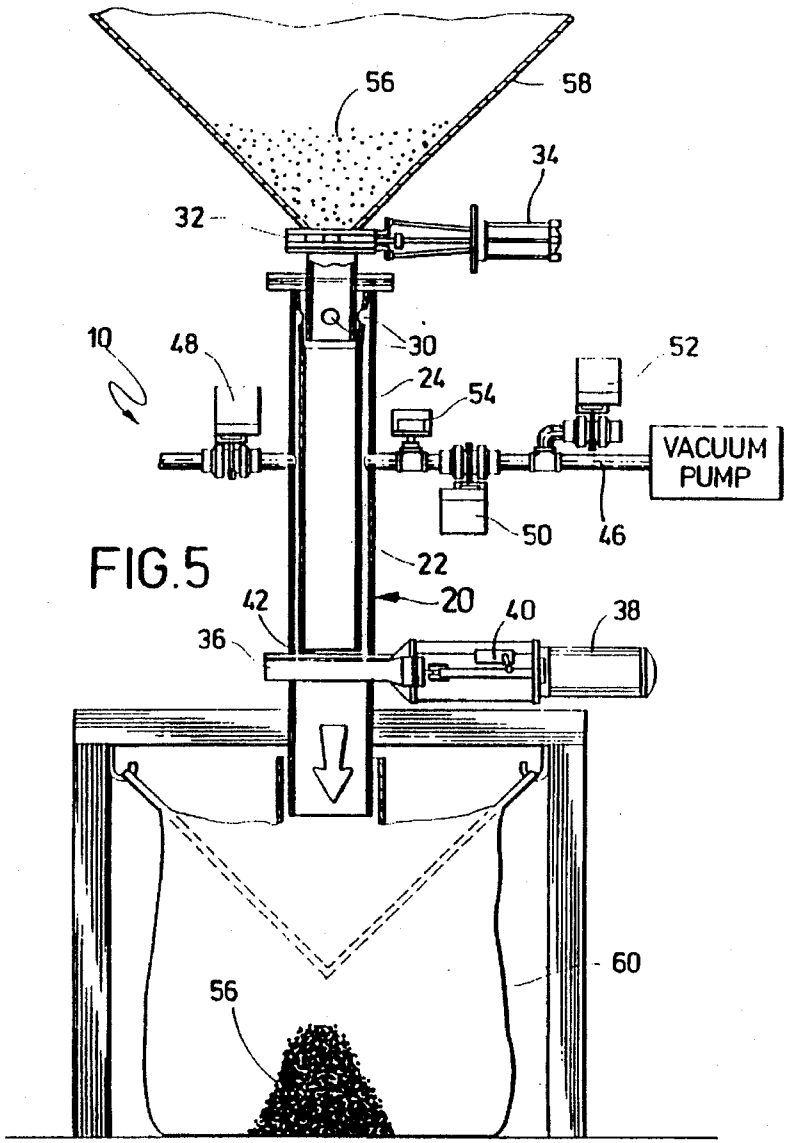
FIG. 5 is a partial sectional view of the vacuum fill system illustrating the deaerated flowable material inside the storage container.

Turning now to FIG. 2, therein is illustrated the initial start up position of the vacuum fill system 10.

In FIG. 2, valves 32, 36, 48, 50 and 52 are closed. The flowable material 56 is contained within a conventional holding/storage device 58, such as a hopper. The vacuum fill system 10 is connected to a semi-bulk bag 60 through conventional means.

Figure 3:
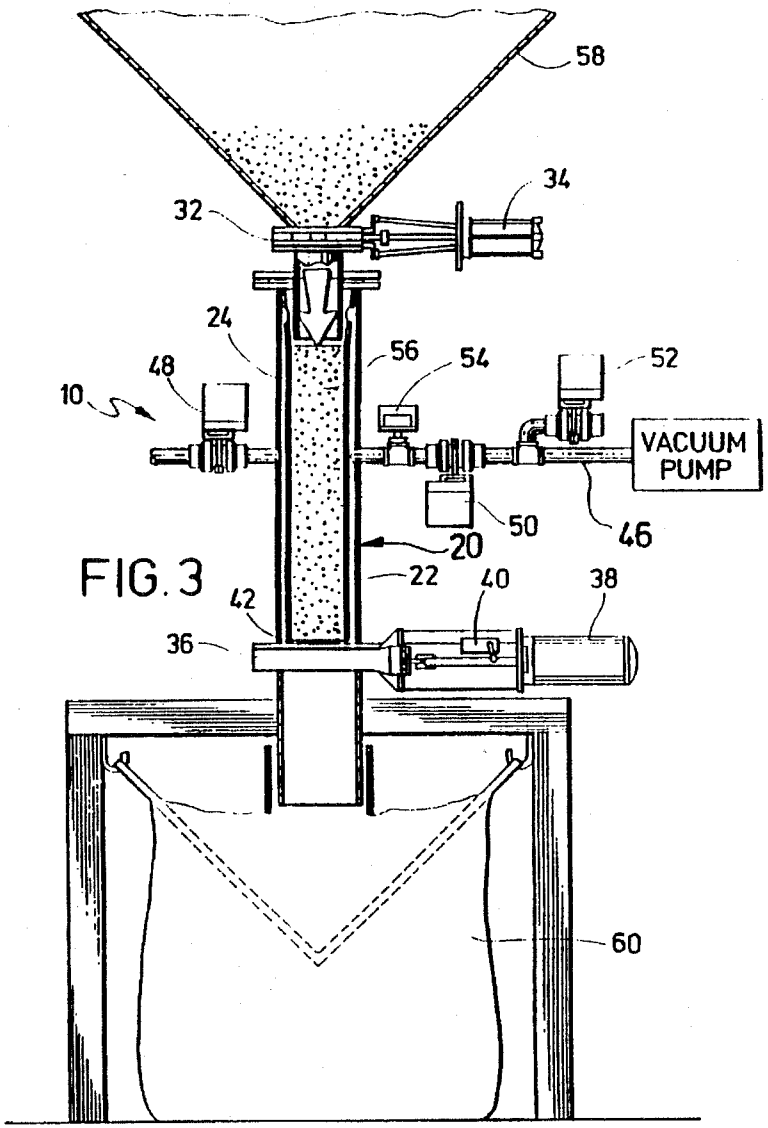
FIG. 3 is a partial sectional view of the vacuum fill system illustrating the filling of the hollow container with flowable material before deaerating.

Turning to FIG. 3, therein it is shown that the hollow, cylindrical container 20 has been filled with flowable material 56. In order to fill the hollow container 20, valves 32 and 48 have been opened. This results in the opening of slide gate valve 32 and the venting of air through valve 48 to the dust collector during the filling process. Once the slide gate valve 32 is opened, the flowable material fills the inner chamber 22 up to the level of the openings 30. Openings 30 and gap 42 allow the dust to be vented to the dust collector through valve 48 and vacuum lines 46.

The flow of flowable materials into the inner chamber 22 is controlled either by weight or height level. When the predetermined level or weight is reached, valve 32 automatically closes preventing the flow of further flowable material 56 into the inner chamber 22 of the hollow, cylindrical container 20.

At this time, valve 48 is closed automatically and valve 50 is opened. This creates a vacuum in the space between the inner and outer chambers 22 and 24.

Figure 4:
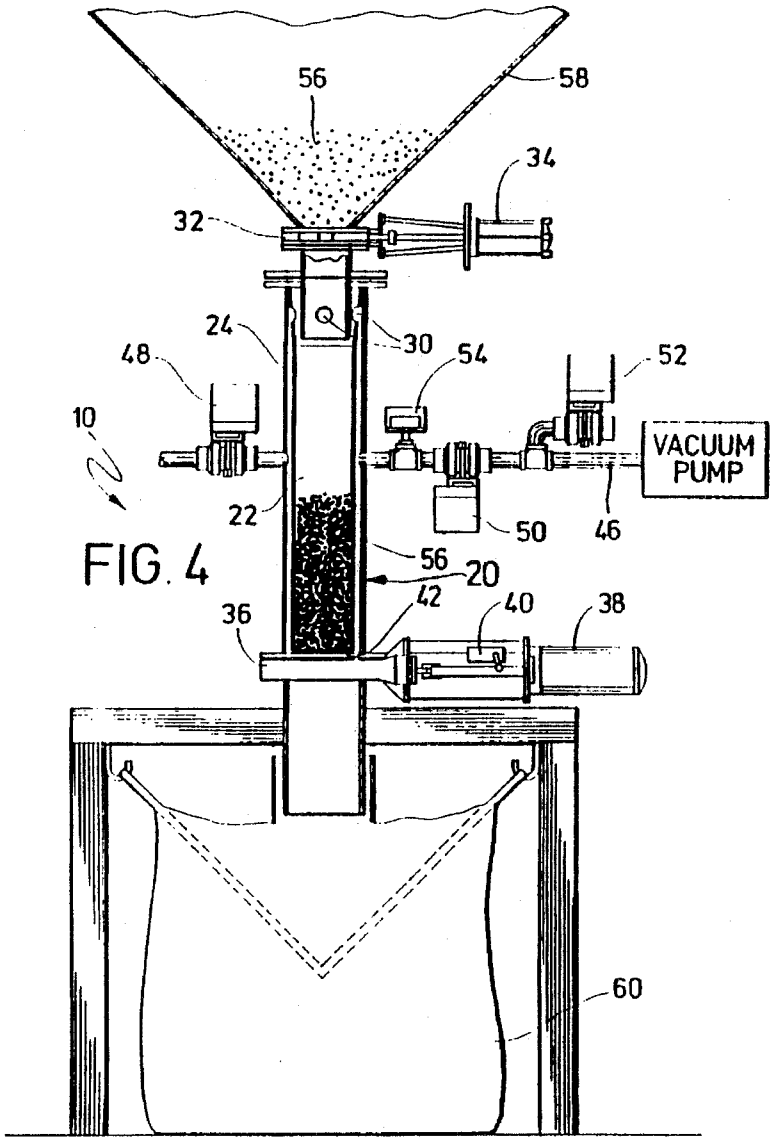
FIG. 4 is a partial sectional view of the vacuum fill system illustrating the deaerated flowable material.

Turning to FIG. 4, therein is illustrated that the flowable material 56 has been deaerated and compacted and that the volume of material 56 is now significantly less than when first introduced into the hollow, cylindrical container 20.

When the air is initially evacuated from the inner chamber 22, the volume of flowable material 56 actually increases slightly as the internal air passes through it and the vacuum is created. Thus, there is actually a volume gain until the chamber is returned to atmospheric pressure.

Once the vacuum reaches the necessary level to achieve the desired deaeration of the flowable material 56, valve 52 is opened immediately. Valve 52 must be opened suddenly and fully in order to get a high impact on the material 56 from the entering air. The impact of the entering air compresses and compacts the deaerated, flowable material 56, both axially and radially, due to the internal low pressure previously created by the vacuum.

Subsequently, valve 36 is opened and the compacted, deaerated flowable material 56 flows as a compact "slug" of material into the desired container or, as illustrated, bulk bag 60. Since the compacted and deaerated material is highly densified and only drops a short distance before entering the container 60, there is very little chance of reaeration.

Finally, after the filling of the container 60 with the flowable materials 56, slide gate valve 36 closes and the vacuum fill system 10 is ready to begin a new cycle.

Figure 6:
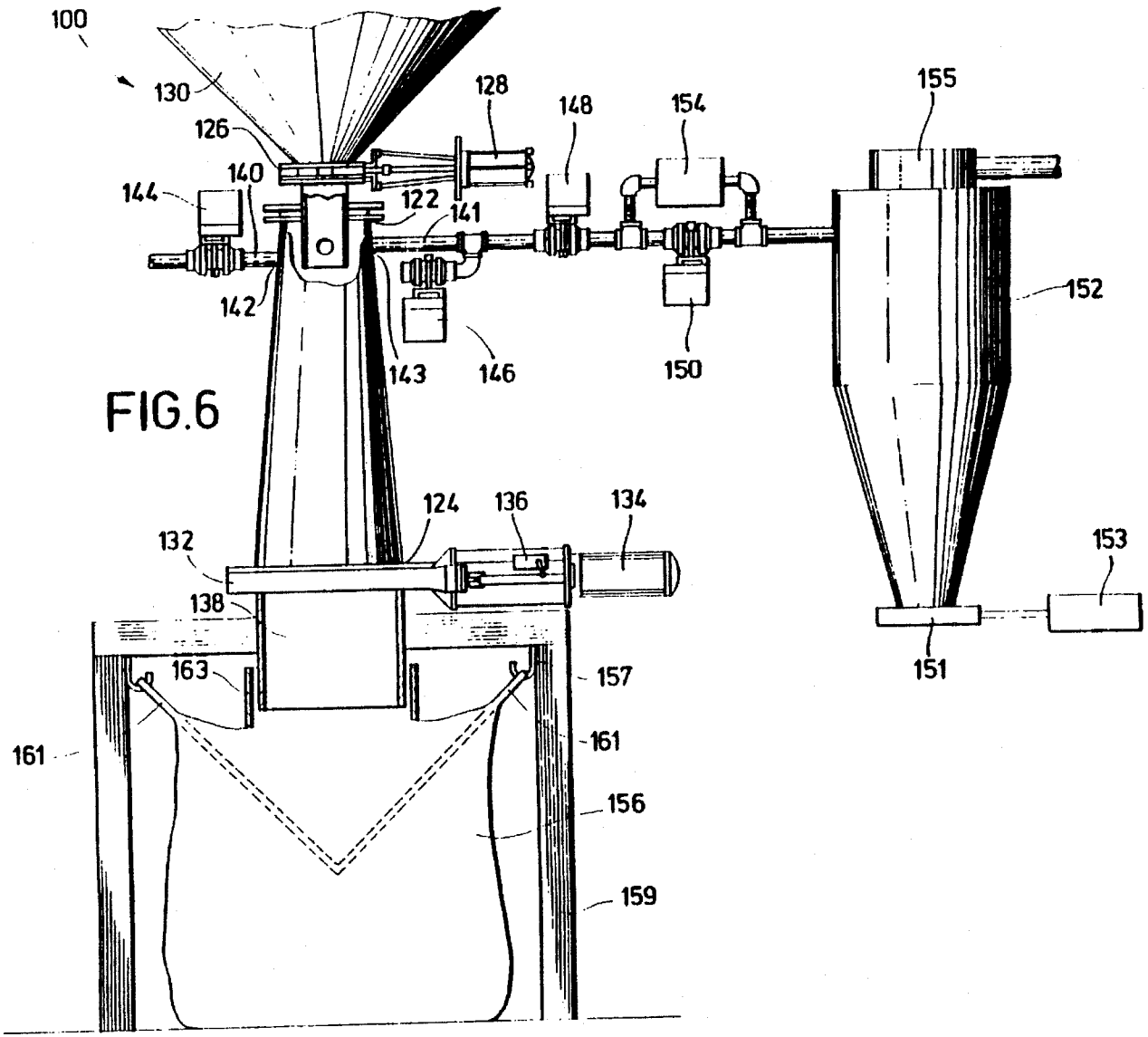
FIG. 6 is a partial sectional view of a second embodiment of the invention.

Referring now to FIG. 6, a second embodiment of the vacuum fill system 100 has a hollow, tapered container 120 having a first end 122 and a second end 124. Attached to the first end 122 of the hollow, tapered container 120 is a conventional knife or slide gate valve 126 and an associated air cylinder 128 which controls the opening and closing of the slide gate valve 126. The slide gate valve 126 and the air cylinder 128 are of conventional types well known in the art. When the slide gate valve 126 is in the open position, flowable materials flow from an input source 130 through the slide gate valve 126 into the hollow, tapered container 120.

At the second end 124 of the hollow, tapered container 120, there is a second knife or slide gate valve 132. An associated air cylinder 134 and a switch 136 are utilized to open or close the slide gate valve 132 to allow flowable materials to exit the hollow, tapered container 120 through a discharge chute 138 after deaeration and compaction. The slide gate valve 132, the air cylinder 134 and the switch 136 are of conventional types well known in the art.

Line 140 runs into an opening 142 in the hollow, tapered container 120 and is connected to a solenoid actuated butterfly valve 144 which is in turn connected to a compressed air source (not shown). A vacuum line 141 runs into an opening 143 in the hollow, tapered container 120, and is connected to a series of solenoid actuated butterfly valves 146, 148, and 150, and from there to a conventional dust collector 152. The dust collector 152 has a knife or slide gate valve 151 and an associated air cylinder 153 to allow discharge of dust and particles from the dust collector. Mounted on top of the dust collector is a fan 155. Connected to the vacuum line 141 on both sides of the butterfly valve 150 is a vacuum pump or high vacuum venturi 154.

As with the first embodiment of the invention, although the vacuum fill system 100 is preferably used in connection with the filling of a semi-bulk container for handling flowable materials, it must be understood that the vacuum fill system 100 is capable of being utilized with any type of container, no matter how large or small, where it is desired to compact, deaerate, and densify the flowable materials for packing into a container for shipment and storage.

Still referring to FIG. 6, during operation of the vacuum fill system 100, a semi-bulk bag 156 is connected to the vacuum fill system 100 through conventional means such as hooks 157 mounted in a frame 159. Support loops 161 on the bag 156 are placed over the hooks 157 to suspend the bag below the discharge chute 138. A collar 163 on the bag 156 is placed around the discharge chute 138 to prevent spillage while filling the bag 156.

Before flowable materials are introduced into the hollow, tapered container 120, the slide gate valves 126 and 132 and the solenoid actuated butterfly valves 144, 146, and 150 are closed to allow evacuation of air from the container 120. The slide gate valve 126 is then opened to fill the hollow, tapered container 120 with flowable material. The slide gate valve 126 is then closed, the valve 148 remains open and the valve 150 is opened to initiate evacuation of air from the filled tapered chamber 120. To further evacuate the filled tapered container 120, the valves 146 and 150 are closed and the valve 148 remains open drawing air from the chamber 120 through action of the vacuum pump or high vacuum venturi 154.

Once the vacuum reaches the necessary level to achieve the desired deaeration of the flowable material, the valve 148 is closed and the valve 146 is opened to suddenly vent vacuum line 141 and the tapered container 120 to the atmosphere. Pressure waves are generated near the upper surface of the container 120 which forces the particles at the top to move downwardly, thereby compressing the small amount of air remaining adjacent the particles at the wave front. The wall of the container 120 prevents the loss of energy in the radial direction, and directs all motion parallel to the axis of symmetry of the container 120. As the pressure in the container 120 increases, the volume of the flowable material decreases in such a way that increasing pressure waves propagate at faster speeds, thereby causing a shock wave to form from the coalescence of many weaker pressure waves. When the wave reaches the bottom of the chamber and contacts the rigid surface of the slide gate valve 132, a reflected wave is generated which propagates back up through the material causing additional compaction. The action of these waves is non-isotropic and irreversible to such an extent that, except for some small elastic recovery, most of the density increase caused by the wave motion is retained.

The slide gate valve 132 and the valve 144 are then opened to allow compressed air to be injected into the tapered container 120, thereby forcing the flowable materials as a compact "slug" of material from the tapered container 120 and into the desired receiving container or, as illustrated, bulk bag 156.

After the "slug" of material is ejected from the tapered container 120 under the force of the compressed air, the slide gate valve 132 closes and the vacuum fill system 100 is ready to begin a new cycle.

Figures 7, 8:
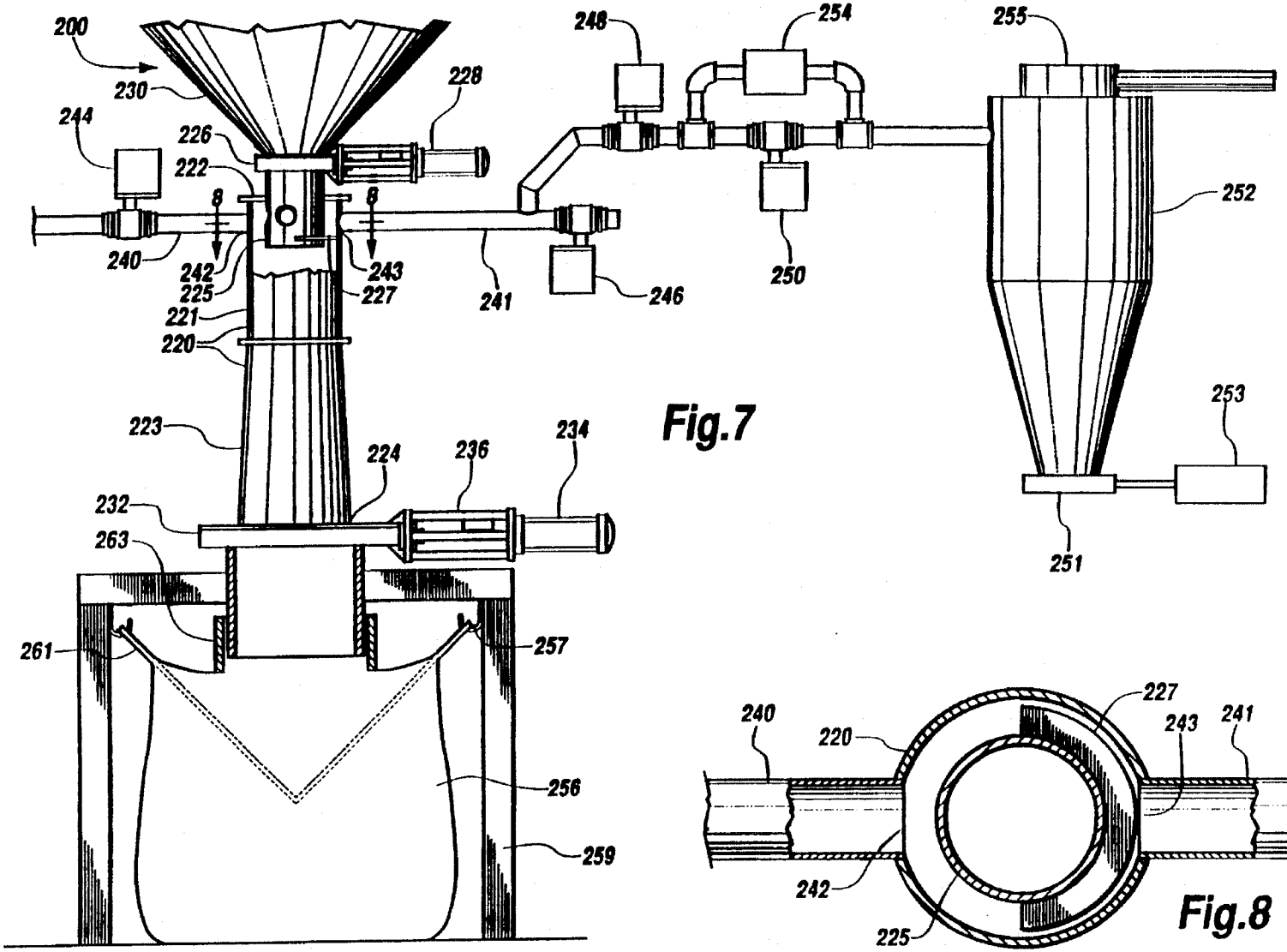
FIG. 7 is a partial sectional view of a third embodiment of the invention.
FIG. 8 is a plain view of a baffle plate located in the hollow container.

Referring now to FIG. 7, a third embodiment of the vacuum fill system 200 has a hollow container 220 having a first end 222 and a second end 224. The hollow container further includes a top section 221 with a substantially vertical sidewall and a lower section 223 with a downward and outwardly tapered sidewall. The hollow container is preferably formed from stainless steel and polished on the inside.

Attached to the first end 222 of the hollow container 220 is a full opening ball or gate valve 226 and an actuator 228 which controls the opening and closing of the valve 226. The valve 226 and the actuator 228 are of conventional types well known in the art. Attached to the lower face of the valve is a tubular nipple 225 of the same diameter as the opening in the gate valve. The tubular nipple 225 extends into the upper section of the hollow container. An annular space is created between the tubular nipple 225 and the upper interior side wall of the hollow container. One or more openings are present in the side wall of the tubular nipple and provide communication between the interior of the nipple and the annular space between the nipple and the sidewall of the hollow container. When the gate valve 226 is in the open position, flowable materials flow from an input source 230 through the gate valve 226 through the tubular nipple 225 into the hollow container 220.

At the second end 224 of the hollow container 220, there is a second full opening ball or gate valve 232. An associated actuator 234 and a switch 236 are utilized to fully open or close the valve 232 to allow compacted materials to exit the hollow, tapered container 220 through a discharge chute 238 after deaeration and compaction. The valve 232, the actuator 234 and the switch 236 are of conventional types well known in the art.

Line 240 runs into an opening 242 in the hollow container 220 and is connected to a solenoid actuated valve 244, which in turn is connected to a compressed air source (not shown). A vacuum line 241 runs into an opening 243 in the hollow container 220 and is connected to a series of solenoid actuated valves 246, 248, and 250, and from there to a conventional dust collector 252. The dust collector 252 has a full opening valve 251 and an actuator 253 to allow discharge of dust and particles from the dust collector. Mounted on top of the dust collector is a fan 255. Connected to the vacuum line 241 on both sides of the butterfly valve 250 is a vacuum pump or high vacuum venturi 254.

Referring now to FIGS. 7 and 8, a half circle baffle 227 is attached to the tubular nipple 225 and positioned slightly below opening 242 and in the annular space between the tubular nipple 225 and the hollow container side wall.

As with the first and second embodiments of the invention, although the vacuum fill system 200 is preferably used in connection with the filling of a semi-bulk container for handling flowable materials, it must be understood that the vacuum fill system 200 is capable of being utilized with any type of container, no matter how large or small, where it is desired to compact, deaerate, and densify the flowable materials for packing into a container for shipment and storage.

Still referring to FIG. 7, during operation of the vacuum fill system 200, a semi-bulk bag 256 is connected to the vacuum fill system 200 through conventional means such as hooks 257 mounted in a frame 259. Support loops 261 on the bag 256 are placed over the hooks 257 to suspend the bag below the discharge chute 238. A collar 263 on the bag 256 is placed around the discharge chute 238 to prevent spillage while filling the bag 256.

In order to fill the hollow container 220, valves 232, 244 and 246 are closed. Valves 226, 248 and 250 are opened. Air is vented through valves 248 and 250 to the dust collector 252. The volume of flowable material fed into the hollow container is controlled by either weight or height. When a predetermined volume is reached, valve 226 is then closed. To further evacuate the filled chamber 220, the valve 250 is closed and valve 248 remains open drawing air from the container 220 through action of the vacuum pump or high vacuum venturi 254.

Once the vacuum reaches the necessary level to achieve the desired deaeration of the flowable material, the valve 248 is closed and the valve 246 is opened to suddenly vent vacuum line 241 and the hollow container 220 to the atmosphere. Pressure waves are generated near the upper surface of the hollow container 220 which force the particles at the top to move downwardly, thereby compressing the small amount of air remaining adjacent the particles at the wave front. The wall of the container 220 prevents the loss of energy in the radial direction, and directs all motion parallel to the axis of symmetry of the container 220. The half circle baffle 227 distributes the pressure wave around tubular nipple 225 providing for more even compaction in the container. As the pressure in the container 220 increases, the volume of the flowable material decreases in such a way that increasing pressure waves propagate at faster speeds, thereby causing a shock wave to form from the coalescence of many weaker pressure waves. When the wave reaches the bottom of the container and contacts the rigid surface of the valve 232, a reflected wave is generated which propagates back up through the material causing additional compaction. The action of these waves is non-isotropic and irreversible to such an extent that, except for some small elastic recovery, most of the density increase caused by the wave motion is retained.

The slide gate valve 232 and the valve 244 are then opened to allow compressed air from an external source (not shown) to be injected into the container 220, thereby forcing the flowable materials as a compact "slug" of material from the container 220 and into the shipping container or, as illustrated, bulk bag 256.

After the "slug" of material is ejected from the container 220 under the force of the compressed air, the slide gate valve 232 closes and the vacuum fill system 200 is ready to begin a new cycle.

Although not shown, it should be understood that the operation of the first, second and third embodiments of the vacuum fill system 10, 100 and 200 may be performed either manually or automatically through the use of conventional electronic circuitry.

Although preferred embodiments of the present invention have been illustrated in the accompanying Drawings and described in the foregoing Detailed Description, it will be appreciated by those skilled in the art that various modifications and rearrangements of the component parts and elements of the present invention are possible within the scope of the present invention.

We claim:

1. A vacuum fill system for deaerating flowable materials for storage in a receiving container disposed beneath the vacuum fill system comprising:

a hollow, upwardly extending container defining a predetermined cross-sectional area for receiving and holding the flowable materials;

the hollow, upwardly extending container having:

a top end and a bottom end, a top portion with a substantially vertical air impervious side wall extending continuously from the top end of the hollow container to a deflection point and comprising the sole connection therebetween, a bottom portion with an upwardly tapered air impervious side wall extending continuously from the deflection point to the bottom end of the hollow container;

a discharge outlet attached to the bottom end of the hollow container and defining an opening having a cross-sectional area at least as large as the largest cross-sectional area defined by the hollow container;

means for controlling the movement of the flowable material into the hollow container;

means for creating a vacuum in the hollow container to temporarily suspend the flowable materials to occupy a slightly greater volume than before creation of the vacuum with the suspended materials having a uniform cross-sectional area substantially the same as the cross-sectional area defined by the hollow container;

means connected to the air impervious side wall in proximity to the top end of the hollow container for returning the pressure in the hollow container to atmospheric pressure substantially instantaneously for compacting the deaerated material into a substantially solid slug of material occupying a cross-sectional area substantially identical to, but slightly smaller than, the cross-sectional area defined by the hollow container; and means for controlling the movement of the substantially solid slug of deaerated, compacted materials as a unitary form from the bottom end of the hollow container.

2. A vacuum fill system for deaerating flowable materials in accordance with claim 1 wherein the means for controlling the flow of the flowable materials into the hollow container further comprises a gate valve and air cylinder attached to the hollow container at the top end.

3. A vacuum fill system for deaerating flowable material in accordance with claim 1 where in the means for creating a vacuum in the hollow container comprises a plurality of valves and a vacuum pump connected by a vacuum line to the hollow container.

4. A vacuum fill system for deaerating flowable material in accordance with claim 1 where in the means for creating a vacuum in the hollow container comprises a plurality of valves and a high vacuum venturi connected by a vacuum line to the hollow container.

5. A vacuum fill system for deaerating flowable materials in accordance with claim 1 wherein the means for returning the pressure in the hollow container to atmospheric pressure substantially instantaneously further comprises a vacuum line and at least one valve capable of opening to the atmosphere.

6. A vacuum fill system for deaerating flowable material in accordance with claim 1 wherein the means for controlling the movement of the deaerated flowable material as a unitary form from the hollow container further comprises a gate valve and associated air cylinder and switch attached to the hollow container at the bottom end.

7. A vacuum fill system for deaerating flowable material in accordance with claim 1 wherein the hollow container is manufactured from stainless steel and has a polished interior.

8. A vacuum fill system for deaerating flowable materials in accordance with claim 1 further including a means for pressurizing the hollow container to force the substantially solid slug of deaerated, compacted materials to fall as a unitary form from the bottom end of the hollow container.

9. A vacuum fill system for deaerating flowable materials for storage in a receiving container disposed beneath the vacuum fill system comprising:

a hollow, upwardly extending container defining a predetermined cross-sectional area for receiving and holding the flowable materials;

the hollow, upwardly extending container having:

a top end and a bottom end, a top portion with a substantially vertical air impervious side wall extending continuously from the top end of the hollow container to a deflection point and comprising the sole connection therebetween, a bottom portion with an upwardly tapered air impervious side wall extending continuously from the deflection point to the bottom end of the hollow container;

a discharge outlet attached to the bottom end of the hollow container and defining an opening having a cross-sectional area at least as large as the largest cross-sectional area defined by the hollow container;

means for controlling the movement of the flowable material into the hollow container;

means for creating a vacuum in the hollow container to temporarily suspend the flowable materials to occupy a slightly greater volume than before creation of the vacuum with the suspended materials having a uniform cross-sectional area substantially the same as the cross-sectional area defined by the hollow container;

means connected to the air impervious side wall in proximity to the top end of the hollow container for returning the pressure in the hollow container to atmospheric pressure substantially instantaneously for compacting the deaerated material into a substantially solid slug of material occupying a cross-sectional area substantially identical to, but slightly smaller than, the cross-sectional area defined by the hollow container;

means for controlling the movement of the substantially solid slug of deaerated, compacted materials as a unitary form from the bottom end of the hollow container; and means for pressurizing the hollow container to force the substantially solid slug of deaerated, compacted materials to fall as a unitary form from the bottom end of the hollow container.

10. A vacuum fill system for deaerating flowable material in accordance with claim 9 wherein the means for pressurizing the hollow container to force the substantially solid slug of deaerated, compacted flowable material as a unitary form out of the hollow container further comprises at least one valve and a line connecting the valve to the hollow container for regulating the flow of compressed air into the hollow container.

11. A vacuum fill system for deaerating flowable materials for storage in a receiving container disposed beneath the vacuum fill system comprising:

a hollow, upwardly extending container defining a predetermined cross-sectional area for receiving and holding the flowable materials;

the hollow, upwardly extending container having:

a top end and a bottom end, a top portion with a substantially vertical air impervious side wall extending continuously from the top end of the hollow container to a deflection point and comprising the sole connection therebetween;

a bottom portion with an upwardly tapered air impervious side wall extending continuously from the deflection point to the bottom end of the hollow container;

a discharge outlet attached to the bottom end of the hollow container and defining an opening having a cross-sectional area at least as large as the largest cross-sectional area defined by the hollow container;

a first gate valve and air cylinder attached to the upper end of the hollow container for controlling the movement of the flowable material into the hollow container, said first gate valve having an inlet and outlet side;

means for creating a vacuum in the hollow container to temporarily suspend the flowable materials to occupy a slightly greater volume than before creation of the vacuum with the suspended materials having a uniform cross-sectional area substantially the same as the cross-sectional area defined by the hollow container;

means connected to the air impervious side wall in proximity to the top end of the hollow container for returning the pressure in the hollow container to atmospheric pressure substantially instantaneously for compacting the deaerated material into a substantially solid slug of material occupying a cross-sectional area substantially identical to, but slightly smaller than, the cross-sectional area defined by the hollow container;

means for controlling the movement of the substantially solid slug of deaerated, compacted materials as a unitary form from the bottom end of the hollow container;

a tubular nipple located inside the hollow container, attached to the outlet side of the first gate valve, through which flowable material entering the hollow container passes; and a half circle baffle plate located below the means for returning the pressure in the hollow container to atmospheric pressure substantially instantaneously and in the annular space formed between the tubular nipple and the hollow container sidewall.

12. A vacuum fill system for deaerating flowable materials for storage in a receiving container disposed beneath the vacuum fill system comprising:

a hollow, upwardly extending container defining a predetermined cross-sectional area for receiving and holding the flowable materials;

the hollow, upwardly extending container having:

a top end and a bottom end, a top portion with a substantially vertical air impervious side wall extending continuously from the top end of the hollow container to a deflection point and comprising the sole connection therebetween, a bottom portion with an upwardly tapered air impervious side wall extending continuously from the deflection point to the bottom end of the hollow container;

a discharge outlet attached to the bottom end of the hollow container and defining an opening having a cross-sectional area at least as large as the largest cross-sectional area defined by the hollow container;

a first gate valve and air cylinder attached to the upper end of the hollow container for controlling the movement of the flowable material into the hollow container, said first gate valve having an inlet and outlet side;

means for creating a vacuum in the hollow container to temporarily suspend the flowable materials to occupy a slightly greater volume than before creation of the vacuum with the suspended materials having a uniform cross-sectional area substantially the same as the cross-sectional area defined by the hollow container;

means connected to the air impervious side wall in proximity to the top end of the hollow container for returning the pressure in the hollow container to atmospheric pressure substantially instantaneously for compacting the deaerated material into a substantially solid slug of material occupying a cross-sectional area substantially identical to, but slightly smaller than, the cross-sectional area defined by the hollow container;

means for controlling the movement of the substantially solid slug of deaerated, compacted materials as a unitary form from the bottom end of the hollow container;

means for pressurizing the hollow container to force the substantially solid slug of deaerated, compacted materials to fall as a unitary form from the bottom end of the hollow container;

a tubular nipple located inside the hollow container, attached to the outlet side of the first gate valve, through which flowable material entering the hollow container passes; and a half circle baffle plate located below the means for returning the pressure in the hollow container to atmospheric pressure substantially instantaneously and in the annular space formed between the tubular nipple and the hollow container sidewall.

13. A vacuum fill system for deaerating flowable material in accordance with claim 12 where in the means for creating a vacuum in the hollow container comprises a plurality of valves and vacuum pump connected by a vacuum line to the hollow container.

14. A vacuum fill system for deaerating flowable material in accordance with claim 12 where in the means for creating a vacuum in the hollow container comprises a plurality of valves and a high vacuum venturi connected by a vacuum line to the hollow container.

15. A vacuum fill system for deaerating flowable materials for storage in a receiving container disposed beneath the vacuum fill system comprising:

a hollow, upwardly extending container defining a predetermined cross-sectional area for receiving and holding the flowable materials;

the hollow, upwardly extending container having:

a top end and a bottom end, a top portion with a substantially vertical air impervious side wall extending continuously from the top end of the hollow container to a deflection point and comprising the sole connection therebetween, a bottom portion with an upwardly tapered air impervious side wall extending continuously from the deflection point to the bottom end of the hollow container;

a discharge outlet attached to the bottom end of the hollow container and defining an opening having a cross-sectional area at least as large as the largest cross-sectional area defined by the hollow container;

a first gate valve and air cylinder attached to the upper end of the hollow container for controlling the movement of the flowable material into the hollow container, said first gate valve having an inlet and outlet side;

means for creating a vacuum in the hollow container to temporarily suspend the flowable materials to occupy a slightly greater volume than before creation of the vacuum with the suspended materials having a uniform cross-sectional area substantially the same as the cross-sectional area defined by the hollow container;

at least one valve for returning the pressure in the hollow container to atmospheric pressure substantially instantaneously thereby compacting the deaerated material into a substantially solid slug of material occupying a cross-sectional area substantially identical to, but slightly smaller than, the cross-sectional area defined by the hollow container, said valve having an inlet and an outlet, said inlet connected to the atmosphere and the outlet connected to the air impervious side wall in proximity to the top end of the hollow container;

a second gate valve and air cylinder attached to the bottom end of the hollow container for controlling the movement of the substantially solid slug of deaerated, compacted materials as a unitary form from the bottom end of the hollow container;

at least one valve connected to an external compressed air source and to the hollow container for forcing the substantially solid slug of deaerated, compacted materials to fall as a unitary form from the bottom end of the hollow container;

a tubular nipple located inside the hollow container, attached to the outlet side of the first gate valve, through which flowable material entering the hollow container passes; and a half circle baffle plate located below the means for returning the pressure in the hollow container to atmospheric pressure substantially instantaneously and in the annular space formed between the tubular nipple and the hollow container sidewall.

* * * * *